US006799443B2

(12) United States Patent
Morita et al.

(10) Patent No.: US 6,799,443 B2
(45) Date of Patent: Oct. 5, 2004

(54) FLATBED KNITTING MACHINE

(75) Inventors: Toshiaki Morita, Wakayama (JP); Kenji Ikoma, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/433,503

(22) PCT Filed: Dec. 3, 2001

(86) PCT No.: PCT/JP01/10567

§ 371 (c)(1),
(2), (4) Date: Jun. 3, 2003

(87) PCT Pub. No.: WO02/46508

PCT Pub. Date: Jun. 13, 2002

(65) Prior Publication Data

US 2004/0031292 A1 Feb. 19, 2004

(30) Foreign Application Priority Data

Dec. 4, 2000 (JP) ..... 2000-368994

(51) Int. Cl.[7] ..... D04B 7/04
(52) U.S. Cl. ..... 66/64; 66/114
(58) Field of Search ..... 66/60 R, 114, 66/64, 104, 106, 107, 110

(56) References Cited

U.S. PATENT DOCUMENTS 5,305,620 A * 4/1994 Yabuta ..... 66/109
5,475,991 A * 12/1995 Yabuta et al. ..... 66/106
5,918,483 A * 7/1999 Schmid et al. ..... 66/64
6,079,233 A * 6/2000 Shima ..... 66/106
6,415,633 B2 * 7/2002 Schmid et al. ..... 66/64

FOREIGN PATENT DOCUMENTS

| | | | |
|---|---|---|---|
| DE | 2144271 | * | 12/1972 |
| DE | 10031684 | * | 1/2002 |
| JP | 38-22956 Y1 | | 11/1963 |
| JP | 51-42225 B2 | | 11/1976 |
| JP | 2-26966 A | | 1/1990 |
| JP | 6-10246 A | | 1/1994 |
| JP | 7-268748 A | | 10/1995 |

* cited by examiner

*Primary Examiner*—Danny Worrell
(74) *Attorney, Agent, or Firm*—Rothwell, Figg, Ernst & Manbeck, P.C.

(57) ABSTRACT

A flat knitting machine (1) comprising a number of needles (15) arranged in needle grooves (13) formed on needle beds (5, 6) in such a manner as to be freely advanced or retracted; sinkers (41, 123), arranged between the needles (15, 15), to work to form loops; and at least a pair of front and back needle beds having a front edge portion (53, 121) and arranged to confront each other across a needle bed gap, wherein the sinker (41, 123) and the front edge portion (53, 121) of the needle bed are both supported on the needle bed in such a manner as to be movable in an advancing and retracting direction of the needle and also control means (60, 151) is provided for controlling an advanced or retracted motion of both of the sinker (41, 123) and the front edge portion (53, 121) of the needle bed, to adjust a dimension of the needle bed gap between the front and back needle beds (5, 6).

8 Claims, 11 Drawing Sheets

Fig. 8
Fig. 8a
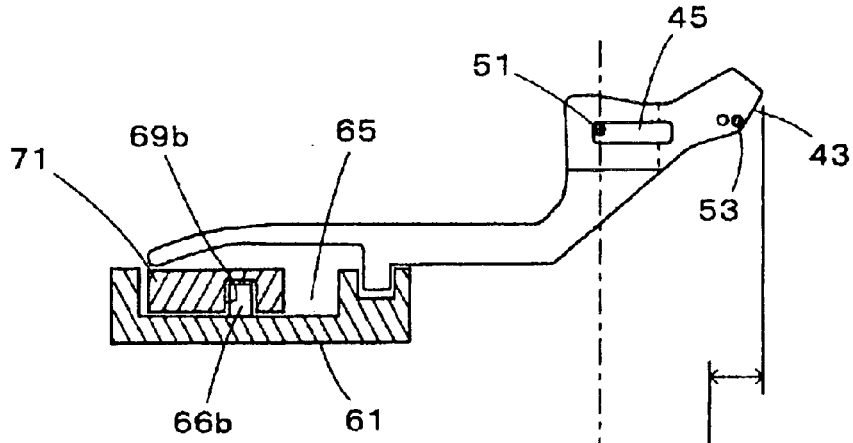
Fig. 8b
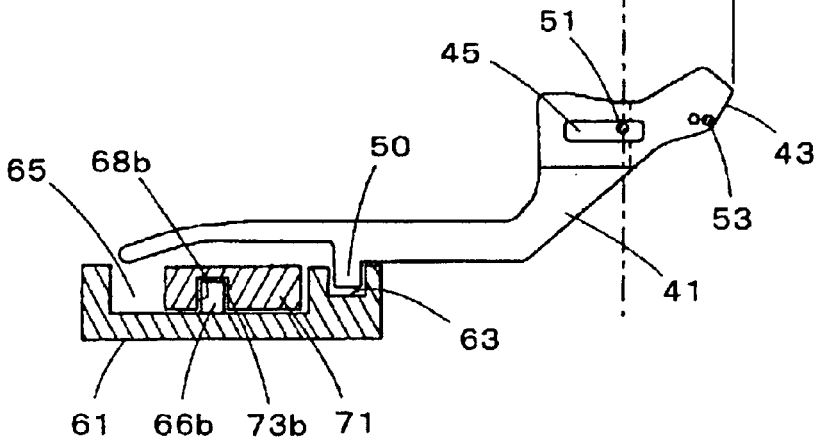

Fig. 10
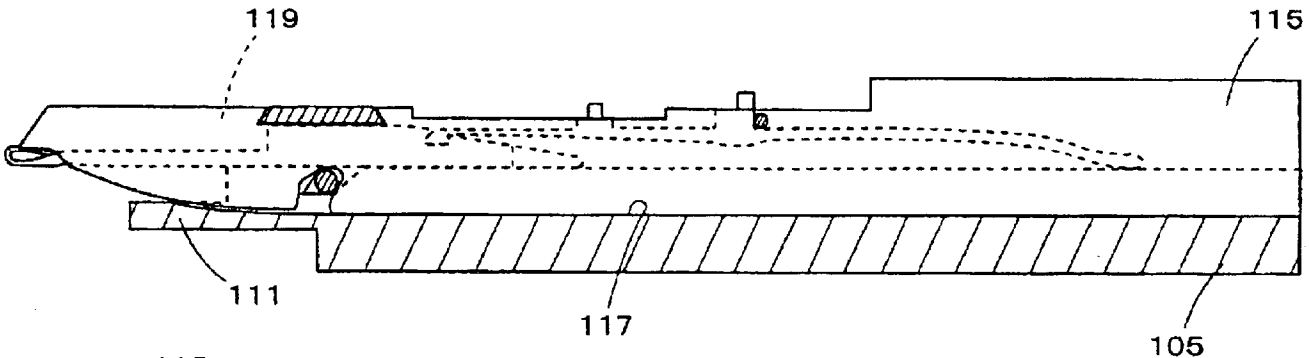
Fig.10a
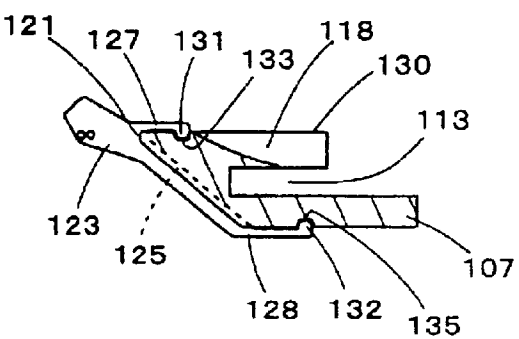
Fig.10b

FLATBED KNITTING MACHINE

TECHNICAL FIELD

The present invention relates to a flat knitting machine comprising front and back needle beds which are arranged to allow adjustment of a width of a needle bed gap therebetween.

BACKGROUND ART

In the flat knitting machine, at least a pair of front and back needle beds are arranged, with their heads confronting each other across a needle bed gap therebetween, and a large number of needles and sinkers are arrayed side by side on the respective needle beds. The dimension of the clearance or gap defined between front edges of the needle beds or sinkers confronting each other in front and back (hereinafter it is referred to as "the needle bed gap") is set in accordance with a needle gauge or a hook size of the flat knitting machine. Some of the flat knitting machines have the capability of adjusting the needle bed gap. The front edges of the needle beds are formed by a piano wire or a base plate of the needle bed itself. For example, the flat knitting machine of this type is constructed so that a plurality of knock-in holes for needle-bed-gap-adjusting knock-pins to be engaged in are bored in a base needle bed at both ends thereof, so that the mounting position of each needle bed on the base needle bed is changed by changing the positions of the knock pins to be inserted in the knock-in holes formed in the base needle beds in accordance with the size (L, M, S) of the needle hook of the needle set in the needle beds. This can allow the position changes of the front edges of the sinkers or the needle beds, to widen or narrow the needle bed gap, and as such enables texture of differences to be provided for a knitted fabric. For example, a knitted fabric of a 6-gauge texture or an 8-gauge texture can be produced by using a 7-gauge knitting machine.

Other flat knitting machines have a needle-bed retracting device which is constructed to retract the needle beds to their retracted positions from their advanced positions where ordinal knitting operations (knitting and loop transfer) are performed, in the course of the knitting of fabric, so that necessary knitting operations are performed at the retracted positions, and then restore the needle beds therefrom to their original advanced positions.

An example of this type of flat knitting machine is a flat knitting machine having a warp yarn insertion mechanism. In this flat knitting machine, while a knitted fabric is knitted by using a welt yarn, the front and back needle beds are kept at their advanced positions. On the other hand, when the knitted fabric is knitted by using a yarn feeder used to insert a warp yarn, i.e., a so-called a lace bar, the needle bed located below the lace bar is retracted downwardly to prevent interference with the lace bar which is swung when lapping operations are performed. For example, Japanese (Examined) Patent Publication No. Sho 51(1976)-42225 illustrates in FIG. 1 this type of flat knitting machine.

Another example is a so-called topping knitting machine which is constructed so that a knitted fabric of a border pattern or a like pattern is transferred from the needles on a needle bed to point needles on a transfer bar located below the needle bed. This topping knitting machine is also provided with a needle-bed retracting mechanism to prevent interference between a transfer member which is advanced from a position below the needle bed toward the needle bed gap and retracted therefrom and the needle bed. For example, Japanese Laid-open (Unexamined) Patent Publication No. Sho 46(1971)-973 illustrates in FIGS. 14 and 15 this type of flat knitting machine.

However, since the knitting machines cited above are all structured so that the entire heavy needle beds are moved toward and away from the needle bed gap in the advancing and retracting direction to change the dimension of the needle bed gap, a large force is required for the adjustment of the needle bed gap. The knitting machines disclosed by Japanese (Examined) Patent Publication No. Sho 51(1976)-42225 and Japanese Laid-open (unexamined) Patent Publication No. Sho 46(1971)-973 are provided with a large scale drive mechanism for providing the required force. On the other hand, in the knock-pin-and-knock-in-hole arrangement, since the positions of the knock pins to the knock-in holes formed in the base needle beds are changed at manual works in accordance with the size variations (L, M, S) of the needle hook of the needles set in the needle beds, no particular drive mechanism is needed, but considerable labor is needed for the position change, instead.

In the light of the problems mentioned above, the present invention has been made. It is an object of the present invention to provide a flat knitting machine that does not require such a large force as the prior art require for the adjustment of the needle bed gap.

Also, it is an object of the present invention to provide a flat knitting machine having the capability of adjusting a width of the needle bed gap between the needle beds in the course of the knitting of a knitted fabric.

DISCLOSURE OF THE INVENTION

The present invention provides a novel flat knitting machine comprising a number of needles arranged in needle grooves formed on needle beds in such a manner as to be freely advanced or retracted; sinkers, arranged between the needles, to work to form loops; and at least a pair of front and back needle beds having a front edge portion and arranged to confront each other across a needle bed gap, wherein the sinker and the front edge portion of the needle bed are both supported on the needle bed in such a manner as to be movable in an advancing and retracting direction of the needle and also control means is provided for controlling an advanced or retracted motion of both of the sinker and the front edge portion of the needle bed, to adjust a dimension of the needle bed gap between the front and back needle beds.

The control means controls the advanced or retracted motion of both of the sinkers and the front edge portion of the needle bed simultaneously.

According to this construction, since the sinker, arranged at the front end portion of the needle bed, to work to form a loop, and the front edge portion of the needle bed facing the needle bed gap between the front and back needle beds are both retractably supported on the needle bed to increase or decrease the width of the needle bed gap, the sinker and the front edge portion can be changed in position on the needle bed, as the need arises, to obtain a desired dimension of the needle bed gap.

In the flat knitting machine above, the sinkers are each supported to be freely advanced toward the needle bed gap or retracted therefrom in a sinker groove formed to extend from a front end of the needle bed toward a back side of the needle bed; the front edge portion of the needle bed is formed by a yarn retaining wire rod extending through insertion holes bored in the sinker in proximity of its front edge to be oriented orthogonal to an advancing-and-retracting direction of the needle and located below an advancing-and-retracting track of the needle; and a controlled portion provided in the sinker at a portion thereof extended along the back side of the needle bed is controllably advanced or retracted by the control means, to allow the advanced or retracted motion of the sinker and the yarn retaining wire rod, so as to adjust the dimension of the needle bed gap.

It is preferable that the respective sinkers are advanced or retracted by a slide member having a controlling portion simultaneously engageable with all of the controlled portions of the sinkers and extending in a width direction of the needle bed.

It is preferable that the controlled portion provided at the sinker is formed by an advance-and-retraction control butt projected out from the back side of the needle bed, and the control butt is engaged in a slotting cam provided in the slider member, to allow the advanced or retracted motion of the sinkers through the slotting cam.

According to this construction, the front edge of the needle bed, on which a loop is retained, is formed by a wire rod inserted in the insertion holes formed in the sinkers and supported by the sinkers, and the sinkers are each provided, at a rearward portion thereof extending along the back side of the needle bed, with the controlled portion engageable with the control means to controllably advance or retract the sinker. This can produce the result that when the controlled portion is advanced or retracted by the control means, not only the sinker but also the wire rod are advanced or retracted simultaneously to adjust the width of the needle bed gap. Also, since the controlled portion is disposed at the back side of the needle bed and is controlled by the control means, the configuration space can be easily ensured, as compared with the configuration wherein such a mechanism is arranged on the upper side of the needle bed.

Also, since the controlled portions of the sinkers arranged in parallel are all engaged in the controlling portion of the slide member which extends along a width direction of the needle bed and is engageable with all the controlled portions of the sinkers simultaneously, the dimension of the needle bed gap can be adjusted by simply operating the slide member to move back and force.

The butts of the sinkers engaged in the slotting cam are advanced and retracted through the slotting cam when the slide member is advanced or retracted.

The needle bed comprises a main body portion of the needle bed and a front end portion of the needle bed which is separated from and located forward of the main body portion of the needle bed and also is movable relative to the main body portion of the needle bed in the advancing-and-retracting direction of the needle and at which the sinker and the front edge portion of the needle bed are provided, and the front end portion of the needle bed is advanced or retracted by the control means, to adjust the dimension of the needle bed gap between the needle beds.

Also, the front end portion of the needle bed is retractably supported on the main body portion of the needle bed.

In this construction, the sinkers and the front end portion of the needle bed defining the front edge portions of the needle bed are formed to be separate from each other and are supported on the needle bed in such a manner as to be movable in the advancing and retracting direction of the needle, and the front end portion of the needle bed is advanced or retracted by the control means, to adjust the dimension of the needle bed gap between the front and back needle beds.

The front and back needle beds may each be provided with a mechanism for adjusting the dimension of the needle bed gap between the needle beds.

In this construction, since the sinkers and the front edge portion of the needle bed can be advanced or retracted separately on the front and back needle beds, the adjustable range of the dimension of the needle bed gap can be further increased. In addition, since the distance advanced or retracted by the front needle bed and the distance advanced or retracted by the back needle bed can be made equal to each other, the dimension of the needle bed gap can be changed finely in accordance with the changes in needle hook size (L, M, S) as well as knitting conditions, such as knitting material and knitting pattern, for knitting the knitted fabric.

BRIEF DESCRIPTION OF THE DRAWINGS

FIG. 8 is a sectional view showing the state of the sinker control means and the sinker taken along line VIII—VIII of FIG. 7, with the needle bed omitted, which shows in FIG. 8*a* the sinker 41 that is in its advanced state and FIG. 8*b* corresponding to FIG. 8*a* shows the sinker 41 that is in its retracted state.

FIG. 10 is a view showing the separated state of a main body portion of a base plate of the needle bed and the head portion of the same.

BEST MODE FOR CARRYING OUT THE INVENTION

In the following, certain preferred embodiments of a flat knitting machine of the present invention will be described with reference to the accompanying drawings.

Embodiment 1

Figure 1:
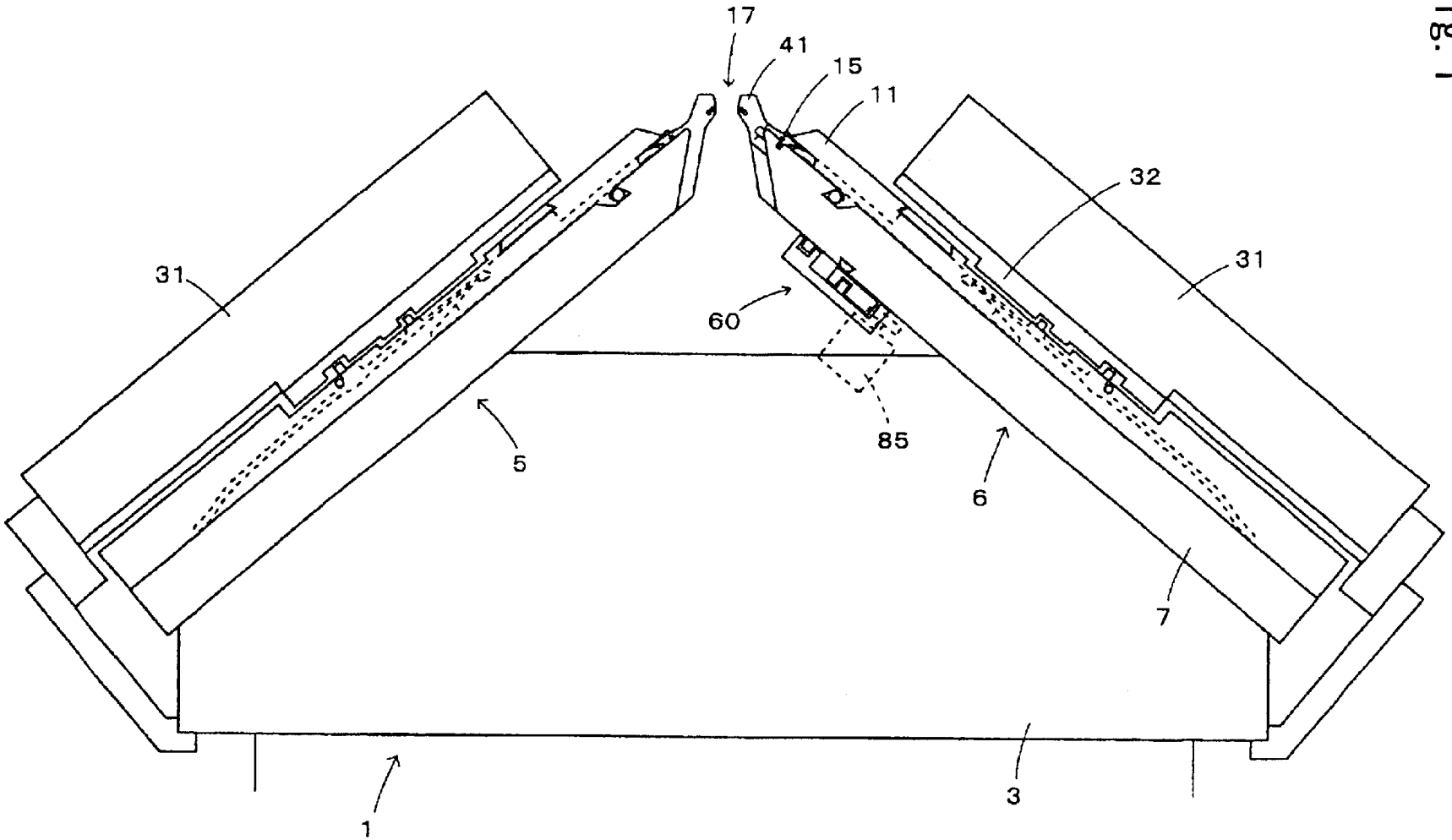
FIG. 1 is a side view schematically illustrating a needle bed part of a flat knitting machine according to the first embodiment of the present invention.
Figure 2:
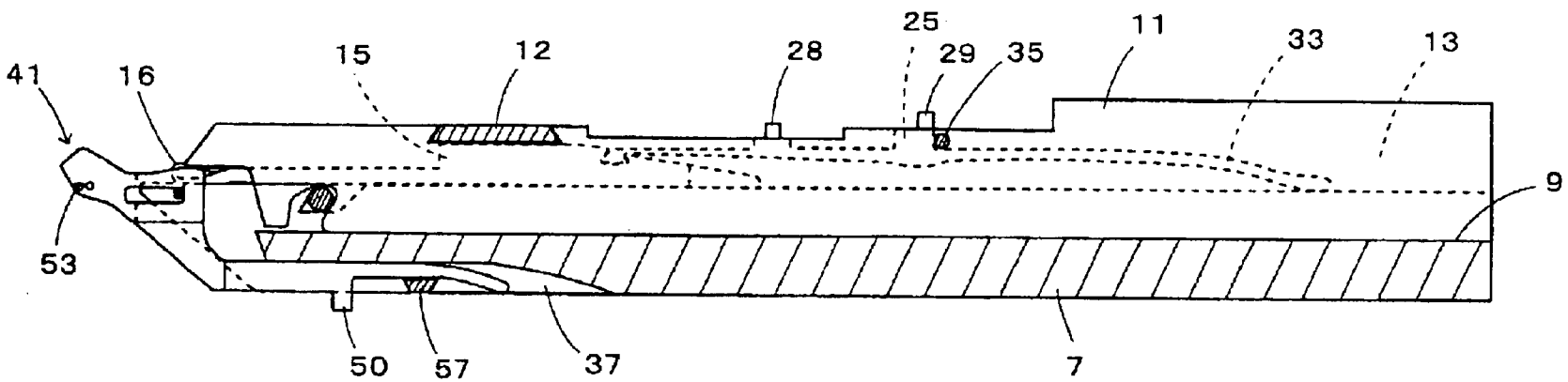
FIG. 2 is a sectional view of one needle bed.
Figure 3:
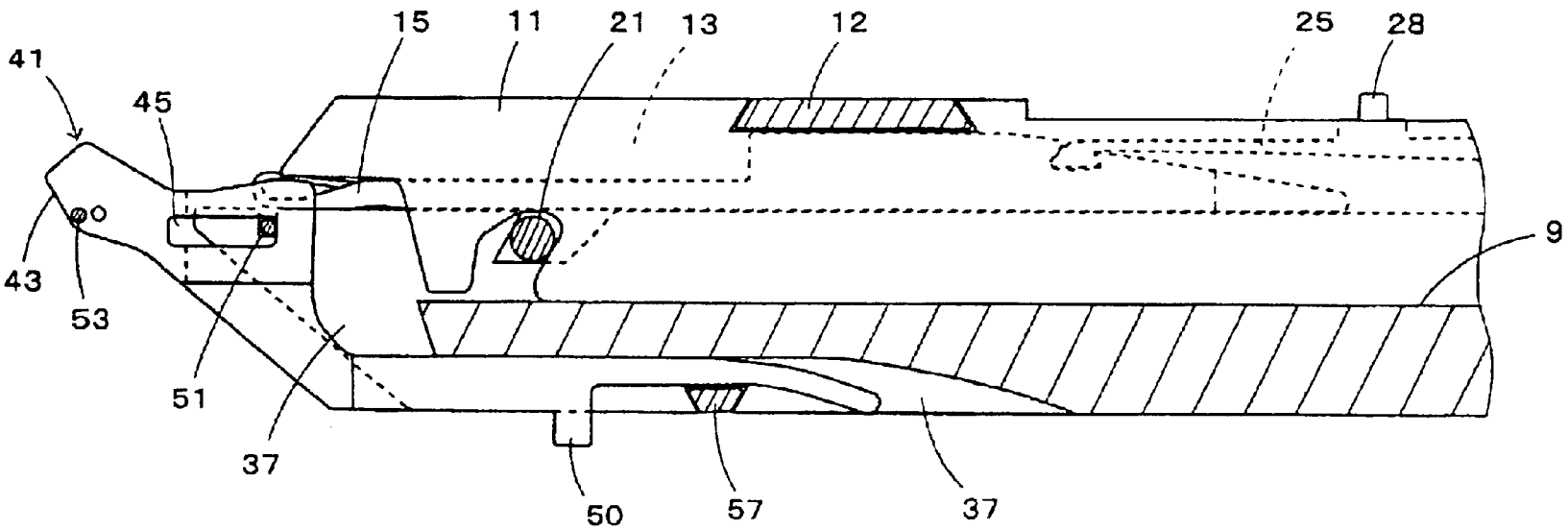
FIG. 3 is an enlarged view of a head portion of the needle bed shown in FIG. 2.
Figure 4:
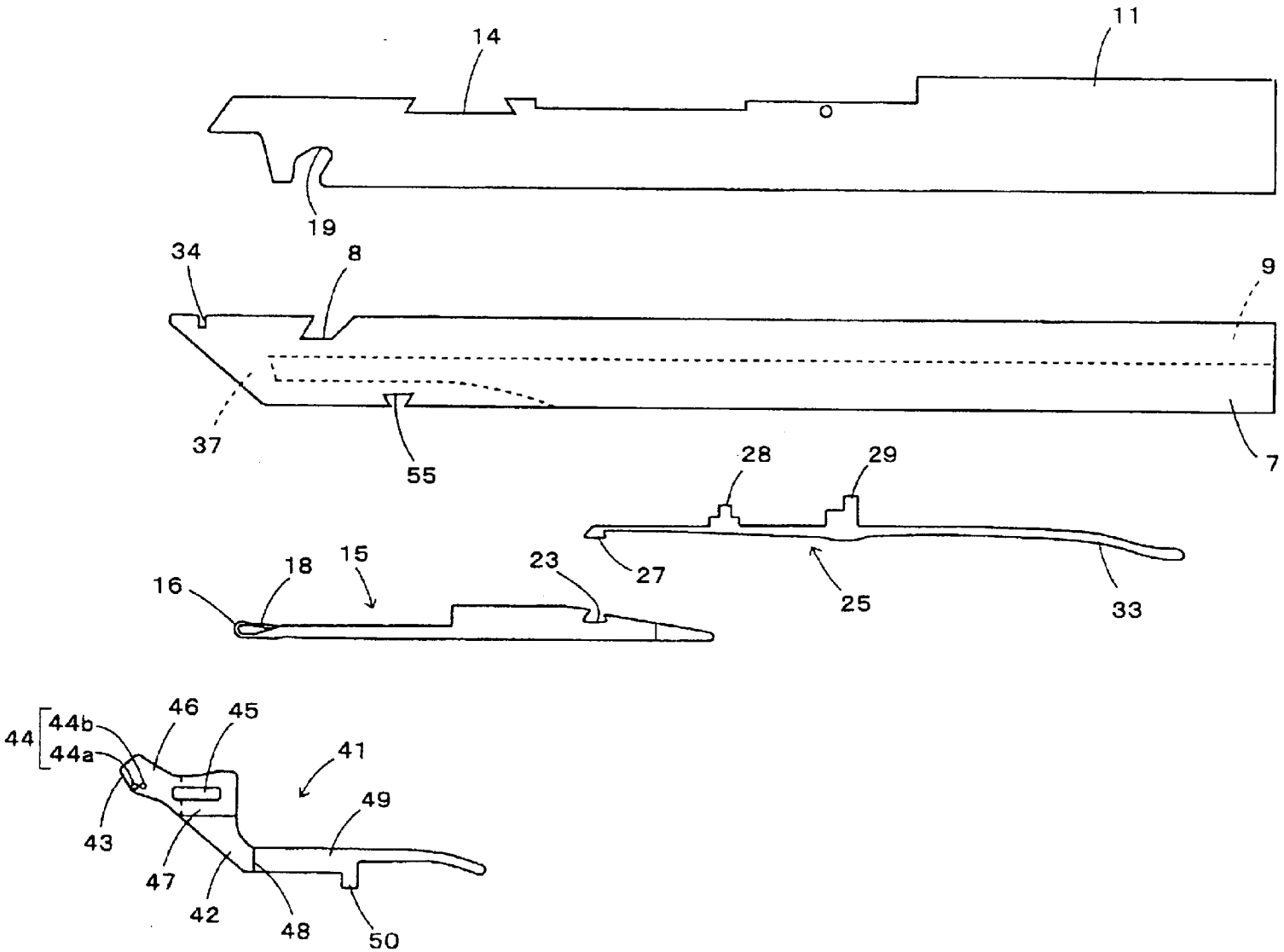
FIG. 4 is an illustration of main parts of the needle bed.

A flat knitting machine 1 of this embodiment comprises a pair of front and back needle beds which are arranged in an inversed V shape to confront each other and on which a large number of needles and sinkers are arrayed side by side. FIG. 1 is a side view schematically illustrating a needle bed part of a flat knitting machine. FIG. 2 is a sectional view of a back needle bed (from which control means mentioned later is omitted). FIG. 3 is an enlarged view of a head portion of the needle bed shown in FIG. 2. FIG. 4 is an illustration of main parts of the needle bed. In the specification, the movement toward the needle bed gap between the front and back needle beds is expressed as "advance" and the movement opposite thereto is expressed as "retraction". Also, a part facing the needle bed gap is expressed as "front" and a part opposite thereto is expressed as "back".

A front needle bed 5 and a back needle bed 6 are carried on a base needle bed 3. In this embodiment, only the back needle bed 6 is equipped with an adjusting mechanism for adjusting a dimension of the needle bed gap 17 between the front and back needle beds 5, 6, and the front needle bed 5 is identical in structure with the conventional one. For simplification of the explanation, reference will be made to the back needle bed 6 only in the following. The back needle bed 6 has a base needle-bed plate 7 having a number of needle plate grooves 9, 9 formed in an upper surface thereof at the same intervals. A number of needle plates 11 are fitted in the number of the needle plate grooves 9, 9 formed in the base needle-bed plate 7, to form needle grooves 13 between adjacent needle plates 11, 11, and needles 15 are supported in the needle grooves 13 in such a manner as to be advanced toward a needle bed gap 17 and retracted therefrom. Each needle plate 11 has a recess 19 formed at its front end portion, and the base needle-bed plate 7 has a recess 8 and a groove 9 formed therein. The needle plate 11 is fixed to the base needle-bed plate 7 in such a manner that the recess 19 of the needle plate 11 is positioned in the groove 9 of the base needle-bed plate 7 by a wire 21 inserted in the grooves 9 to orthogonally extend therethrough and also a rear end portion of the needle plate 11 is crimped. A latch needle 15 having, at its tip, a needle hook 16 opened and closed by a swinging motion of a latch 18 is accommodated in each needle groove 13. Different type of needles, such as a compound needle whose needle hook is opened and closed by using a slider, may be used. The needles 15 are properly supported in the needle grooves 13 by a presser plate 12 engaged in notches 14 which are formed in upper surfaces of the needle plates 11 and are oriented orthogonal to the needle grooves 13.

The needle 15 is combined with a jack 25 by putting a protrusion 27 formed at a tip of the jack 25 into engagement in a recess 23 formed at a rear end portion of the needle 15. The jack 25 has advance-and-retraction controlling butts 28, 29 to be engaged with a cam 32 projecting from the needle bed and arranged on a carriage 31. With the butts 28, 29 engaged with the cam 32 on the carriage 31, the jack 25 is advances and retracted and thereby the needle 15 is advanced toward the needle bed gap 17 and retracted therefrom. The jack 25 has an elastic leg 33 formed to extend along the bottom of the needle groove. In the condition in which the butts 28, 29 are biased to project out from the needle grooves via the elastic leg 33, the jack 25 is held in the needle groove by a wire 35 extending in a longitudinal direction of the needle bed.

The base needle-bed plate 7 has, at its head portion facing the needle bed gap 17, a sinker groove 37 communicating with the needle plate groove 9 and extending rearwardly along the bottom of the base needle-bed plate 7. The sinker grooves 37 are formed to have the same width as the needle plate grooves and are also at the same pitch as the needle plate grooves. The sinkers 41 are accommodated in the sinker grooves 37. The head portion of the base needle-bed plate 7 is partially cut out to form a notch 34 oriented orthogonal to the advancing and retracting direction of the needle 15. A wire 51 is bridged laterally in the notch 34. The wire 51 will be described later.

The sinker 41 is formed by a generally L-shaped plate member and has, at its front edge, a loop forming edge 43 for allowing a sinker loop to be retained when the loop is formed. It also has an insertion hole 44, formed immediately behind the loop forming edge 43, for inserting therein a metal wire rod, such as a piano wire, used for retaining a knitting yarn. The insertion hole 44 is located immediately below an advancing-and-retracting track of the needle, and the piano wire 53 is inserted in the insertion hole 44 of the sinker 41 and is bridged laterally. A front portion of the piano wire 53 facing the needle bed gap serves as a front edge portion of the needle bed, whose edge can allow an old loop to be knocked over from the needle when a loop is formed. This front edge portion of the needle bed is commonly called "verge".

In the illustrated embodiment, the sinker 41 has two insertion holes 44*a*, 44*b* formed therein. By selectively switching between the insertion holes 44*a*, 44*b* for the piano wire to be inserted in, the timing of the knock-over of the old loop can be adjusted finely. Formed behind the insertion hole 44 is a slot 45 in which the wire 51 used to support the sinker on the base needle-bed plate in a freely advancing and retracting manner is engaged.

The plate member of the sinker 41 has a front end portion 46 formed to have a thin wall and a slot forming portion 47 which is formed to be identical in thickness with the needle plate 11 and around which the sides of the needle are supported at the front end portion of the needle bed. It is also formed to have an intermediate portion 42 extending between the slot forming portion 47 and an L-shape bent portion 48 of the sinker and having a thin wall formed by machining one side surface thereof and a rearward portion 49 extending rearwardly from the L-shape bent portion 48 which is formed to be identical in thickness with the slot forming portion 47. A space defined by the intermediate portion 42 serves to dust off flying fiber dusts and the like so as to prevent accumulation of the fiber dusts in the sinker grooves.

The rearward portion 49 of the sinker 41 has a control butt 50 serving as a controlled portion and projecting downwardly from a lower surface of the base needle-bed plate 7. The sinker 41 is prevented from dropping off by the wire 51 inserted in the slot 45 at the front side of the sinker and by a presser plate 57 inserted in notches 55 formed in the lower surfaces of the base needle-bed plates 7 at the rear side of the sinker. The sinker 41 is supported on the needle bed by the wire 51 and the presser plate 57 so that it can be freely advanced toward the needle bed gap 17 and retracted therefrom.

Figure 5:
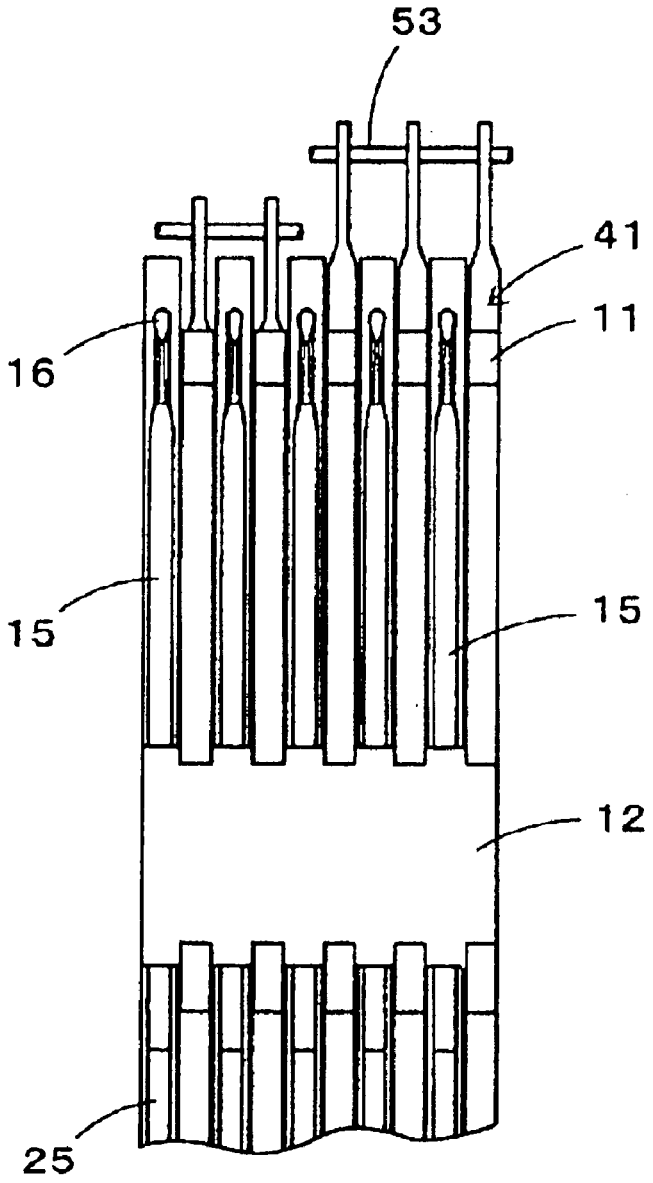
FIG. 5 is a plan view of the head portion of the needle bed.
Figure 6:
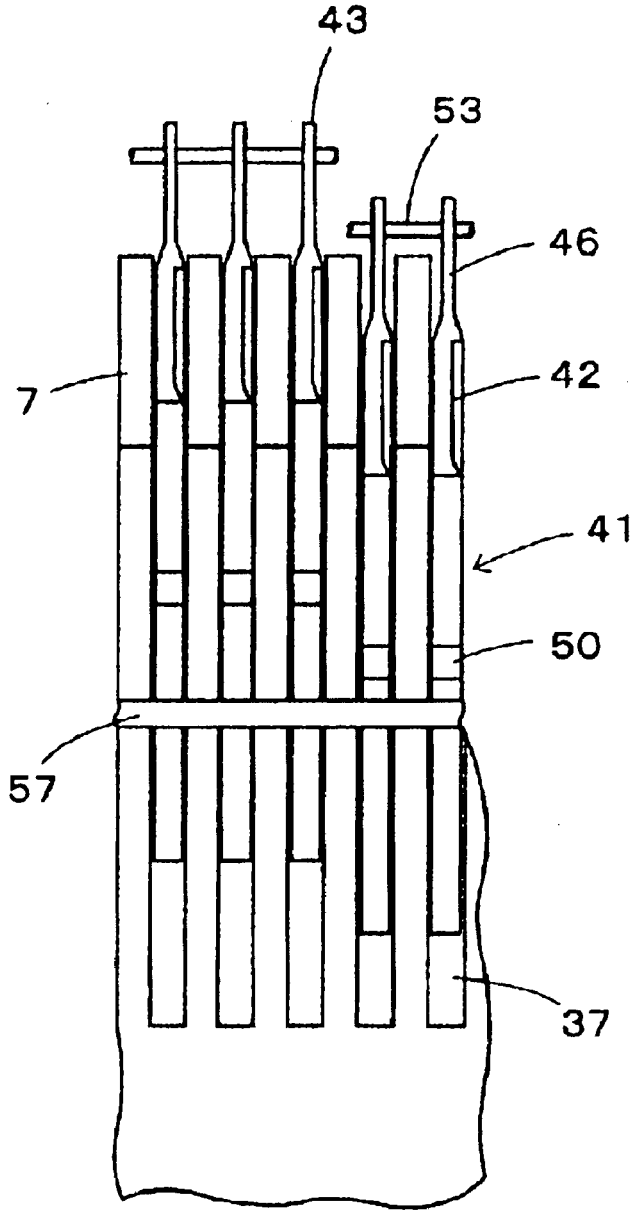
FIG. 6 is an illustration of the head portion of the needle bed as viewed from the bottom of the needle bed.

FIG. 5 is a plan view of the head portion of the needle bed. FIG. 6 is an illustration of the head portion of the needle bed as viewed from the bottom of the needle bed. The sinker 41 and the piano wire 53 are both operated to move back and forth simultaneously by control means mentioned later. For the purpose of easy understanding of the advanced and retracted state, the illustration is divided in half, one half of which represents the state in which the needle bed gap is narrowed and another half of which represents the state in which the needle bed gap is widened, and from which the control means is omitted.

Figure 7:
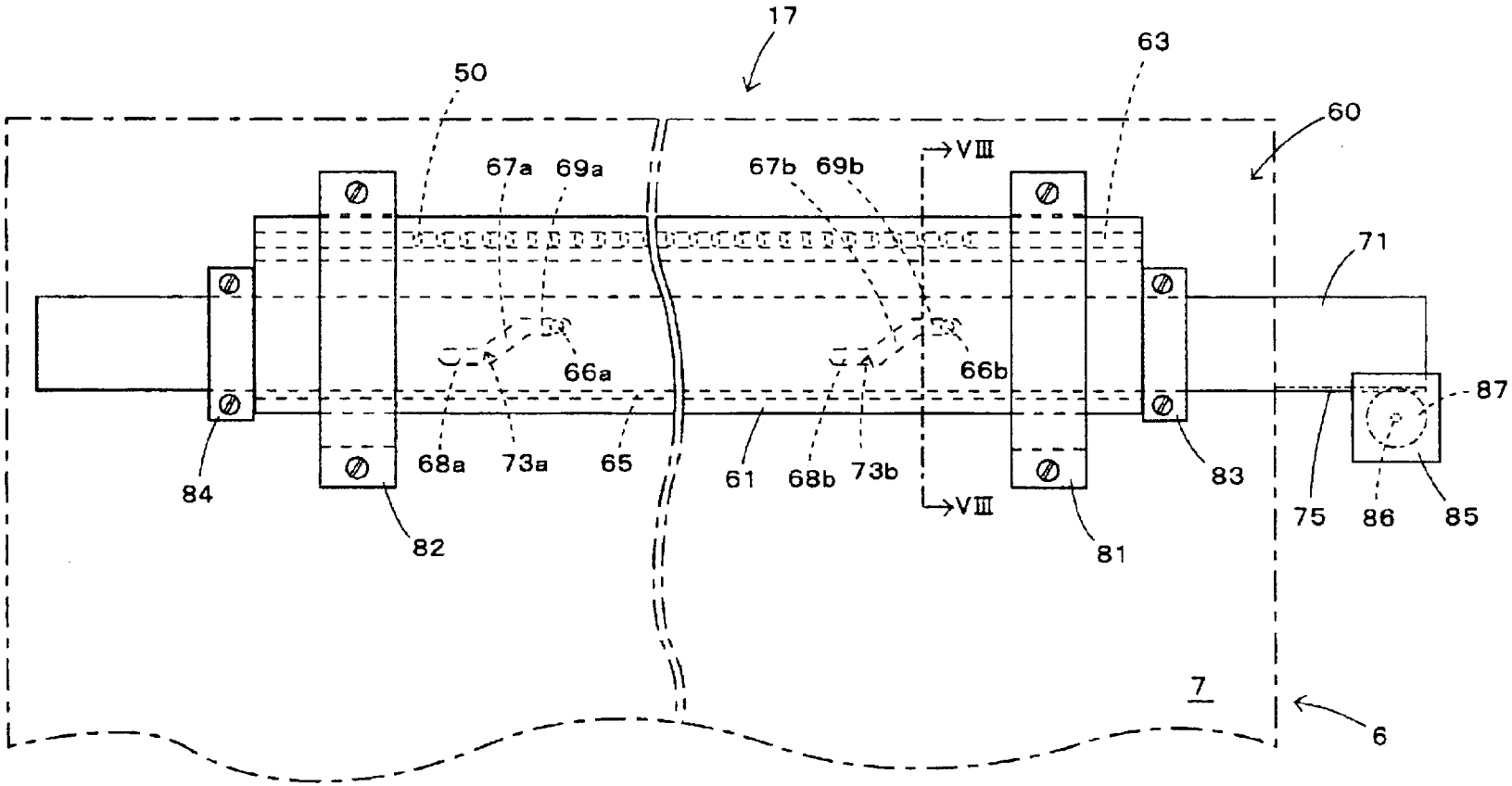
FIG. 7 is an illustration of sinker control means for controlling the advancing and retracting motion of the sinker as viewed from the bottom of the needle bed.

Next, reference is made of the control means 60 for controlling the advancing and retracting motion of the sinker 41 and piano wire 53. FIG. 7 shows the back needle bed 6 as viewed from the bottom. A first slide bar 61, which extends in a widthwise direction of the needle bed to be orthogonal to a line of the sinker grooves 37 arranged in parallel and is capable of advancing toward the needle bed gap 17 and retracting therefrom and a second slide bar 71 arranged between the first slide bar 61 and the needle bed 6 and movable laterally are slidably mounted on a back side of the needle bed by mounting members 81, 82, 83 and 84.

The first slide bar 61 has a slotting cam 63 extending along a width thereof, which is formed at a front side thereof confronting the back side of the needle bed. The control butt 50 of each of the sinkers 41 arranged in parallel is projected into the slotting cam 63. The first slider bar 61 has an accommodating portion 65, formed at a rear portion of the slotting cam 63, for accommodating the second slide bar 71. In the accommodating portion 65, cam followers 66*a*, 66*b* are projected toward the needle bed.

The second slide bar 71 has slotting cams 73*a*, 73*b* formed at locations corresponding to the cam followers 66*a*, 66*b*. The slotting cams 73*a*, 73*b* are engaged with the cam followers 66*a*, 66*b* of the first slide bar 61, to cause the first slide bar 61 to advance toward the needle bed gap and retract therefrom. The second slide bar 71 is serrated at one end portion thereof to form a rack 75 thereat, and a pinion 87 rotatably supported by a motor shaft 86 of a drive motor 85 is threadedly engaged with the rack 75. The drive motor 85 is fixed in place to the base needle bed 3 via mounting members not shown.

When the drive motor 85 is driven in a normal rotation direction or in an opposite direction, the second slide bar 71 is moved rightwards or leftwards to cause the cam followers 66*a*, 66*b* to move between upper and lower flat portions 68, 69 along the slotting cams 73*a*, 73*b*, passing through inclined portions 67*a*, 67*b* of the slotting cams and, as a result, the first slide bar 61 is advanced or retracted. Since the advancing or retracting operation of the first slider bar 61 can provide the simultaneous advance or retraction of the control butts 50 of the sinkers 41 engaged in the slotting cams 63, the loop retaining edge 43 of the sinker and piano wire 53 that act on the loop are advanced or retracted simultaneously. FIG. 8 is a sectional view showing the state of the sinker control means and the sinker taken along line VIII—VIII of FIG. 7, with the needle bed omitted. FIG. 8*a* shows the sinker 41 that is in its advanced state, and FIG. 8*b* corresponding to FIG. 8*a* shows the sinker 41 that is in its retracted state. It should be noted that in the case where the back needle bed is a needle bed constructed to be racked, the sinker 41 can be advanced or retracted without being affected by the racking by the slotting cam 63 of the first slide bar 61 to be engaged with the control butt 50 of the sinker 41 being extended to an extent that allows for the racking.

Now, operation of the back needle bed of the flat knitting machine 1 of this embodiment will be described.

In this flat knitting machine 1, when the sinker 41 and the piano wire 53 are in their advanced positions, usual knitting operation such as knitting and loop transfer is performed to knit a knitted fabric. Then, when the sinker 41 and the piano wire 53 are retracted from their advanced positions, the drive motor 85 of the sinking driving means 60 is rotated rightwards as viewed in FIG. 7, to move the second slide bar 71 rightwards via the rack-and-pinion. As a result of this, the cam followers 66*a*, 66*b* are guided from the upper flat portions 69*a*, 69*b* in the slotting cams 73*a*, 73*b* to the lower flat portions 68*a*, 68*b*, and as such allows the first slide bar 61 to retract. This causes the sinker 41 and the piano wire 53 to be retracted from the needle bed gap, so that the needle bed gap 17 is increased in width, as compared with the needle bad gap required for the usual knitting operation.

While the sinker 41 and the piano wire 53 are kept at their retracted positions, required knitting operations are performed. The knitting operations depends on the type of the knitting machine used, as previously mentioned. For example, when the needle bed of the topping knitting machine is in the retracted position, a transfer member is advanced from a position below the needle bed toward the needle bed gap to receive a loop, so as to transfer a border pattern knitted during this from the needles on the needle bed to point needles on the transfer bar located below the needle bed, first. Then, after required knitting operations, such as lowering of the transfer member, are performed, the drive motor 85 is rotated in a left-hand rotation direction to move the second slide bar 71 rightwards, so as to advance the first slide bar 61. As a result of this, the needle bed gap between the needle beds is restored to its original state in which the knitted fabric is knitted.

As mentioned above, according to the flat knitting machine of the present invention, the width of the needle bed gap is adjusted by moving only a part of the components of the needle bed arranged around the needle bed gap, such as at least the sinker and the front edge portion of the needle bed, with respect to the needle bed gap, rather than by advancing and retracting the entire needle bed as in the conventional flat knitting machine. Thus, a relatively small driving force is required for moving the needle bed, thus enabling reduction of the size of the control means. While in this embodiment, the back needle bed is constructed so that the sinker and the piano wire of the back needle bed can be advanced or retracted to adjust the width of the needle bed gap, the front needle bed may also have the same construction as the back needle bed, so that the sinkers and the piano wires are advanced or retracted on the respective needle beds. Also, rotation speed of the motor shaft of the drive motor may be changed variably to adjust the dimension of the needle bed gap finely.

Second Embodiment

Figure 9:
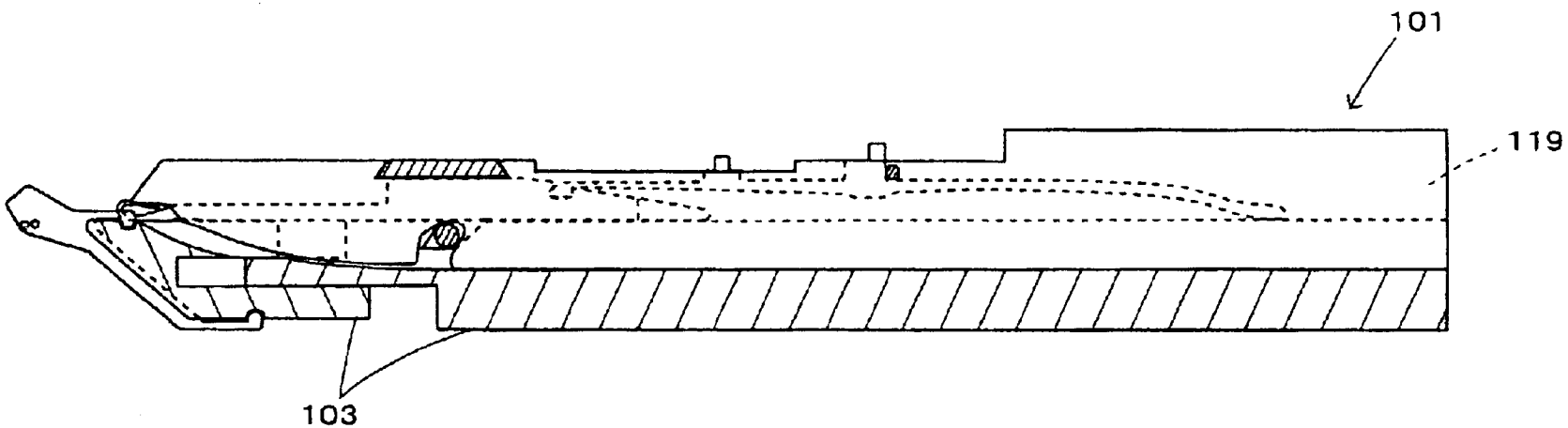
FIG. 9 is a sectional view of a needle bed of the flat knitting machine according to the second embodiment of the present invention.

As mentioned above, the needle bed of the flat knitting machine of the first embodiment is constructed so that the sinkers through which the piano wire forming the front end of the needle bed is extended are retractably supported at the front end of the needle bed. In contrast, the needle bed 101 of the second embodiment is constructed so that the base needle-bed plate 103 is divided into a main body portion 105 and a front end portion 107, as seen from the sectional view of FIG. 9. FIG. 10 shows the separated state of the main body portion 105 of the base needle-bed plate 103 and the front end portion of the same.

The main body portion 105 of the needle bed 101 has, at its front end, a supporting portion 111. The supporting portion 111 of the main body portion 105 is engaged in a recessed portion 113 formed in a rear end surface of the front end portion 107 of the base needle-bed plate, to support the front end portion 107 of the base needle-bed plate on the main body portion 105 of the base needle-bed plate. The main body portion 105 and front end portion 107 of the base needle-bed plate are machined, so that needle grooves 117 and 118 in which the needle plates 115 are fitted are formed at the same pitch on the upper surface of the main body portion 105 and the upper surface of the front end portion 107, respectively. The needle grooves 119 are formed between the inserted needle plates 115, 115. The front end portion 107 of the base needle-bed plate is restrained from moving laterally with respect to the main body portion 105 of the base needle-bed plate in the condition in which the needle plates 115 are fitted in the needle grooves. The needle plates 115 serves as guide members for guiding the front end portion 107 when advanced toward the needle bed gap or retracted therefrom.

The front end portion 107 of the base needle-bed plate has a front edge 121 which serves as the verge engageable with a loop and also has the sinker groove 125 in which the sinker 123 is engaged. The entire sinker 123 is formed from a thin plate of a uniform thickness, and the sinker groove 125 has a width smaller than the needle plate fitting groove 117. The sinker 123 has a leg 127 extending rearwardly from the front edge 121 of the front end portion 107 of the base needle-bed plate and an elastic leg 128 extending to a lower surface of the base needle-bed plate. The sinker 123 is fixed to the front end portion 107 of the base needle-bed plate by bringing engaging lugs 131, 132 provided at front ends of the legs 127, 128 of the sinker 123 into engagement with retaining portions 133, 135 provided at the front end portion 107 of the base needle-bed plate. The verge (front edge) may be formed by the piano wire, as is the case with the first embodiment mentioned above, or alternatively, both the verge and the sinker may be machined together with the front end portion of the base needle-bed plate. An upper surface 130 of the front end portion 107 of the base needle-bed plate serves as a sliding surface on which the needle is slidably supported. The remaining parts that have not been described above correspond to those of the first embodiment.

Figure 11:
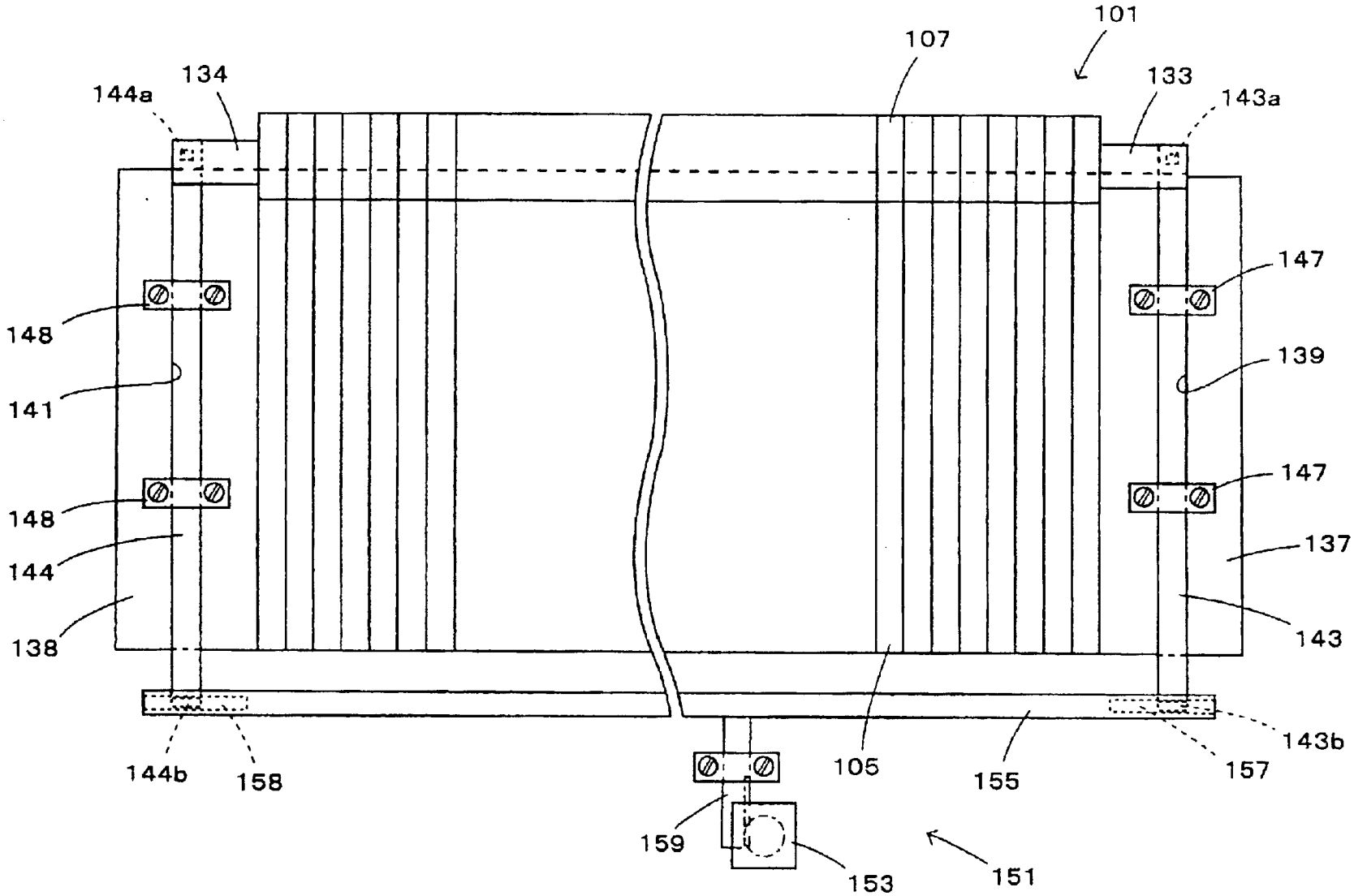
FIG. 11 is a plan view of the needle bed simplified to be easy to understand the outline construction of the control means for adjusting the width of the needle bed gap.

FIG. 11 is a plan view of the needle bed simplified to be easy to understand the outline construction of the control means for adjusting the width of the needle bed gap. The front end portion 107 of the base needle-bed plate is provided, at both ends thereof, with engaging parts 133, 134 which are projected out widthwise for connecting with the control means 151, in order to advance or retract the front end portion 107 of the base needle-bed plate toward or from the main body portion 105 of the base needle-bed plate. The main body portion 105 of the base needle-bed plate has grooves 139, 141 formed in upper surfaces thereof at the both ends 137, 138 where no needle is arranged. Operating levers 143, 144 are accommodated in the grooves and are fixedly mounted by mounting plates 147, 148. Each operating lever 143, 144 has, at a front end portion thereof, a fitting portion 143*a*, 144*a* to engage with the engaging part 133, 134. It also has, at a rear end portion thereof, an engaging portion 143*b*, 144*b* to engage in a fitting groove 157, 158 formed in a drive lever 155 which is driven back and forth by a rotational drive of a drive motor 153 mentioned later. 159 denotes a rack for converting the rotational motion of the drive motor 153 to a reciprocating motion. The rack 159 is fixed to the drive lever 155 at a front end thereof. The fitting grooves 157, 158 of the drive lever 155 have a length extending in the width direction to allow for advancing or retracting motion of the drive lever 155 even when the needle bed is racked. By displacing the front end portion 107 of the base needle-bed plate relative to the main body portion 105 of the base needle-bed plate, the sinker and the verger are advanced toward the needle bed gap or retracted therefrom and thereby the dimension of the needle bed gap is adjusted.

Although the driving mechanism driven from the top side of the needle beds has been illustrated as an example, the driving mechanism may be properly modified, for example, by driving the driving mechanism from the bottom side of the needle beds. In place of the rack-and-pinion, a linkage mechanism or any proper mechanism may of course be used to accomplish the intended object.

The flat knitting machine thus constructed enables the sinker and piano wire, which are located near the needle bed gap to define the dimension of the needle bed gap, to be set at any selective position, as required. This enables the dimension of the needle bed gap to be adjusted in accordance with the changes of knitting conditions such as needle hook size. Also, the mechanism of the present invention is applicable to the needle-bed retracting mechanism of the flat knitting machine having the warp warn insertion mechanism, to avoid interference between the lace bar and the needle bed. In addition, the mechanism of the present invention is also applicable to the topping knitting machine, in which the transfer members are advanced from a position below the needle bed toward the needle bed gap, as a needle bed retracting mechanism.

Since the embodiments illustrated above are both constructed to allow the movement of only the members arranged near the needle bed gap, a decreased driving force is required for the actuation, as compared with the conventional art which is constructed to move the entire heavy needle bed. In the first embodiment in particular, since the members to be advanced or retracted by the control means comprise a small number of relatively lightweight components, i.e., the sinker and the piano wire, there can be provided the advantage that a further decreased driving force is required for the actuation.

As shown in FIG. 1, although the control jack of the needle is in engagement with the cam on the carriage through their projections and depressions, since the control jack of the needle is controllably advanced or retracted while it is kept in the state of being engaged with the cam on the carriage, the disadvantage involved in the conventional needle bed retracting mechanism that the needle bed cannot be retracted until after the carriage is retracted out of the needle bed to disengage the control jack from the cam can be eliminated. Accordingly, the width of the needle bed gap can be adjusted in the course of the knitting of the knitted fabric.

It is needless to say that changes and modifications may be made in the present invention without departing from the spirit and scope of the invention. For example, while in the embodiments illustrated above, the needle grooves are formed between the needle plates arranged in parallel on the base needle-bed plate, the needle grooves may be formed directly in the base needle-bed plate. Also, although the embodiments using the drive motor to adjust the width of the needle bed gap in the course of the knitting of the knitted fabric have been illustrated above, in the case of the flat knitting machine in which the adjustment of the needle bed gap is required only once for the change of size of the needle hook or the change of knitting pattern, modification may be made to adjust the needle bed gap at manual works without providing any specific drive mechanism.

What is claimed is:

1. A flat knitting machine comprising a number of needles arranged in needle grooves formed on needle beds in such a manner as to be freely advanced or retracted: sinkers, arranged between the needles, to work to form loops; and at least a pair of front and hark needle beds having a front edge portion and arranged to confront each ether across a needle bed gap, wherein the sinker and the front edge portion of the needle bed are both supported on the needle bed in such a manner as to be movable in an advancing and retracting direction of the needle and also control means is provided for controlling an advanced or retracted motion of both of the sinker and the front edge portion of the needle bed, to adjust a dimension of the needle bed gap between the front and back needle beds.

2. The fiat knitting machine according to claim 1, wherein the control means controls the advanced or retracted motion of both of the sinkers and the front edge portion of the needle bed simultaneously.

3. The flat knitting machine according to claim 2, wherein each sinker is supported to be freely advanced toward the needle bed gap or retracted therefrom in a sinker groove formed to extend from a front end of the needle bed toward a back side of the needle bed; wherein the front edge portion of the needle bed is formed by a yarn retaining wire rod extending through insertion holes bored in the sinker in proximity of its front edge to be oriented orthogonal to an advancing-and-retracting direction of the needle and located below an advancing-and-retracting track of the needle; and wherein a controlled portion provided in the sinker at a portion thereof extended along the back side of the needle bed is controllably advanced or retracted by the control means, to allow the advanced or retracted motion of the sinker and the yarn retaining wire rod, so as to adjust the dimension of the needle bed gap.

4. The flat knitting machine according to claim 2, wherein the respective sinkers are advanced or retracted by a slide member which is provided with a controlling portion simultaneously engageable with all of the controlled portions of the sinkers and extends in a width direction of the needle bed.

5. The flat knitting machine according to claim 3, wherein the controlled portion provided at the sinker is formed by an advance-and-retraction control butt projected out from the back side of the needle bed, and the control butt is engaged in a slotting cam provided in the slider member, to allow the advanced or retracted motion of the sinkers through the slotting cam.

6. The flat knitting machine according to claim 1, wherein the needle bed comprises a main body portion of the needle bed and a front end portion of the needle bed which is separated from and located forward of the main body portion of the needle bed and also is movable relative to the main body portion of the needle bed in the advancing-and-retracting direction of the needle and at which the sinker and the front edge portion of the needle bed are provided, and wherein the front end portion of the needle bed is advanced or retracted by the control means, to adjust the dimension of the needle bed gap between the needle beds.

7. The flat knitting machine according to claim 6, wherein the front end portion of the needle bed is retractably supported on the main body portion of the needle bed.

8. The fiat knitting machine according to claim 1, wherein the front and back needle beds are each provided with a mechanism for adjusting the dimension of the needle bed gap between the needle beds.

* * * * *